United States Patent [19]

Wilford

[11] 4,185,739

[45] Jan. 29, 1980

[54] RETENTION OF ARTICLES ON A SHEET

[75] Inventor: William P. Wilford, Northampton, England

[73] Assignee: The Mettoy Company Limited, Northampton, England

[21] Appl. No.: 907,347

[22] Filed: May 18, 1978

[30] Foreign Application Priority Data

May 20, 1977 [GB] United Kingdom ..... 21395/77

[51] Int. Cl.[2] ..... B65D 5/52

[52] U.S. Cl. ..... 206/45.14; 206/335; 206/477; 206/489

[58] Field of Search ..... 206/335, 477, 480, 481, 206/483, 495, 486–490, 45.14, 45.15, 45.19; 46/201

[56] References Cited

U.S. PATENT DOCUMENTS

| | | | |
|---|---|---|---|
| 2,387,639 | 10/1945 | Bouchelle | 206/481 |
| 2,968,394 | 1/1961 | Appelt | 206/45.14 X |
| 3,275,274 | 9/1966 | Hutcheon | 206/481 X |
| 3,533,503 | 10/1970 | Wood | 206/45.34 X |
| 3,927,765 | 12/1975 | Beal | 206/45.14 X |
| 3,963,123 | 6/1976 | Beal | 206/477 X |

FOREIGN PATENT DOCUMENTS

| | | | |
|---|---|---|---|
| 1486201 | 4/1969 | Fed. Rep. of Germany | 206/45.14 |
| 1255885 | 10/1961 | France | 206/477 |
| 1135339 | 12/1968 | United Kingdom | 206/480 |

*Primary Examiner*—Joseph Man-Fu Moy
*Attorney, Agent, or Firm*—Watson, Cole, Grindle & Watson

[57] ABSTRACT

An assembly of an article, for example a toy vehicle, retained on a sheet in which the article is located on one side of the sheet and is held by a retainer which comprises a body portion on the opposite side of the sheet to the article and projections which extend from the body portion and engage in recesses in the article, for example in the wheels of a toy vehicle.

7 Claims, 8 Drawing Figures

RETENTION OF ARTICLES ON A SHEET

Figure 1:
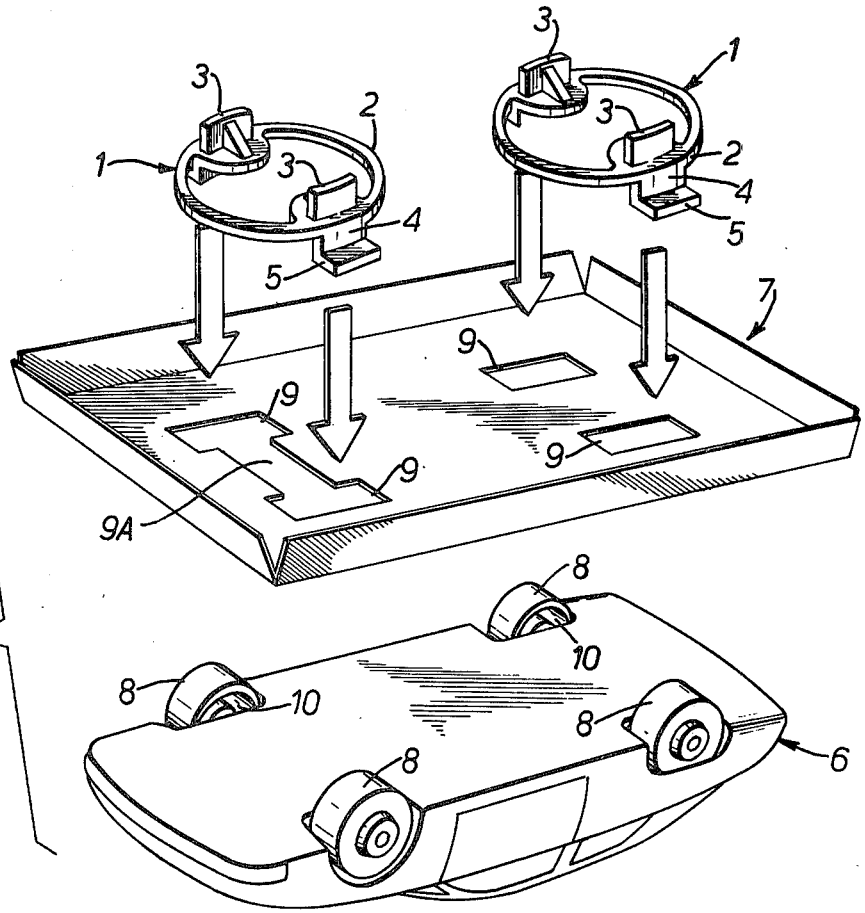

This invention relates to the retention of articles on a sheet and is particularly, but not exclusively, applicable to retaining toy models for packaging.

Previously, toy models, for example toy vehicles, have been packaged in cartons which comprise a flat base sheet of cardboard and a plastics cover which shrouds the model and is secured to the base sheet. Difficulty has, however, been experienced in positioning the models on the sheet while the plastic cover is located and attached to the sheet, and in retaining the models, particularly relatively heavy models, in the finished cartons.

In accordance with the present invention, there is provided an assembly of an article retained on a sheet, the article having at least two recesses or apertures formed therein, wherein the article is located on one side of the sheet by a retaining means which comprises a body portion on the opposite side of the sheet relative to the article and at least two projections which extend from the body portion and engage in the respective recesses in the article.

The article may be a toy vehicle, in which case the recesses may be formed in the road wheels of the vehicle. The wheels of the vehicle may protrude through the sheet and be engaged by the projections on the same side of the sheet as the body portion of the retaining means, or alternatively the wheels may be located on the same side of the sheet as the main part of the vehicle and the projections may extend through the holes or apertures in the sheet and engage the wheels on the side of the sheet opposite the main body portion of the retaining means.

In one embodiment of the invention described in more detail below, the retaining means is a resiliently deformable member and is preferably made from plastics material. The member can be deformed to permit insertion of the projections into the recesses in the vehicle.

In an alternative embodiment, the retaining means has two projections, at least one of which has a cam surface. One projection is first inserted into the recess of one wheel and the other is inserted in its recess of the other wheel by gradually displacing or deforming the wheel on its axle by engagement of the wheel with the cam surface. When the wheel is sufficiently deformed the cam projection enters its wheel recess and the wheel resumes its normal position.

The invention also provides retaining means for securing an article to a sheet.

In one aspect, there is provided a retaining means for retaining an article on a sheet, comprising a deformable body portion of generally annular form and two opposed projections extending transversely outwardly from the body portion.

Preferably, the projections are formed on arms which depend downwardly from the body portion and there may be provided upwardly extending portions which are grippable between thumb and forefinger to deform the body portion.

In another aspect, there is provided a retaining means for retaining an article on a sheet, comprising a body portion having two projections extending laterally outwardly therefrom, one of the projections having a cam surface.

The projections are preferably opposite one another. The body portion preferably has an upstanding grippable portion which may extend the length of the body portion.

Figure 2:
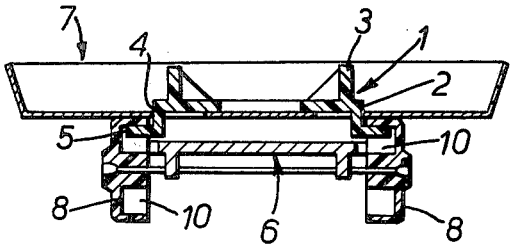
Figure 3:
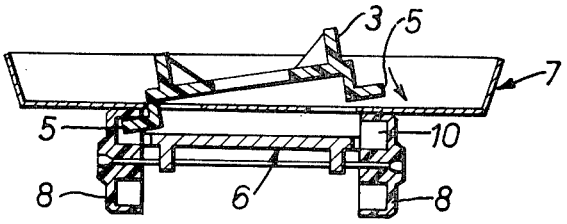
Figure 4:
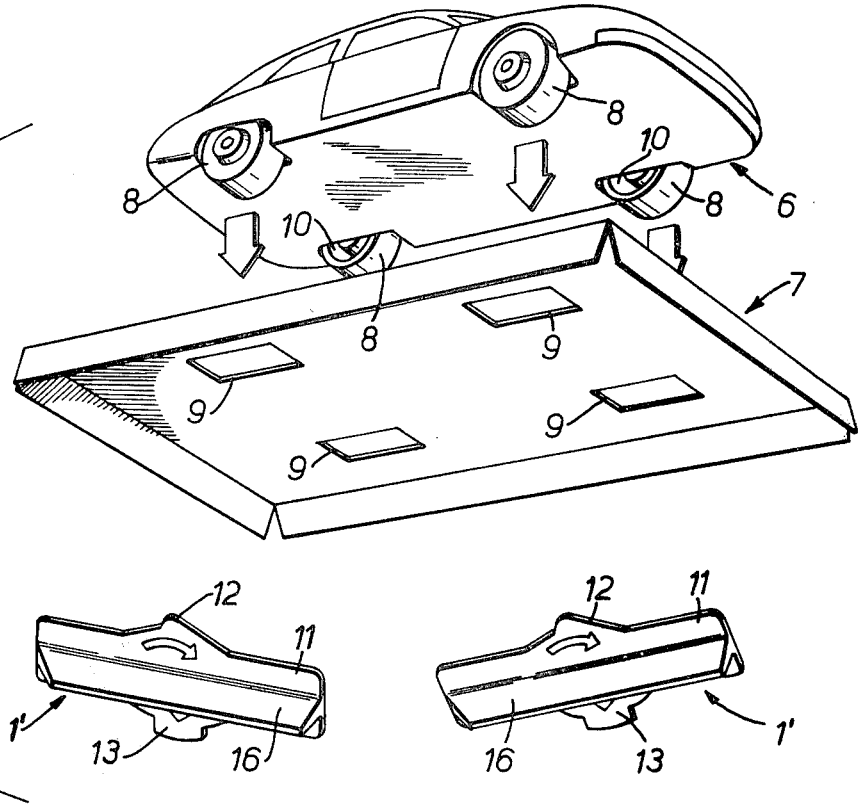
Figure 5:
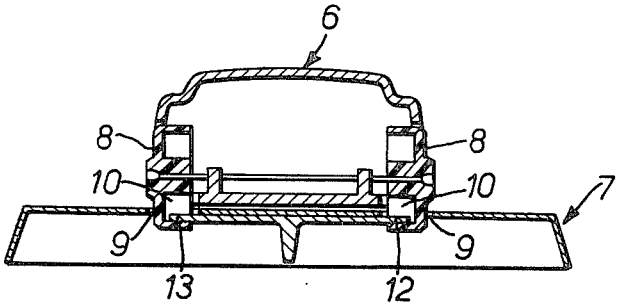
Figure 6A:
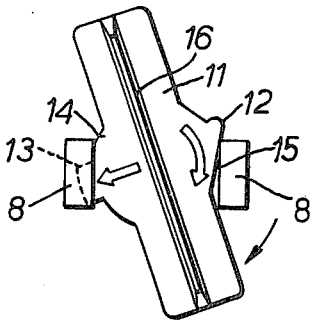
Figure 6B:
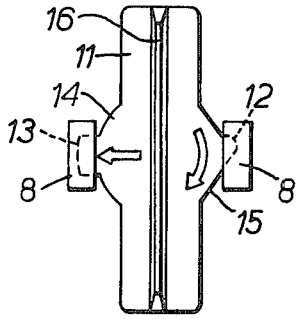
Figure 6C:
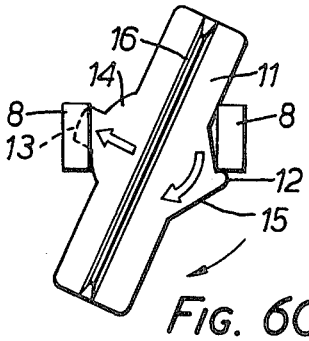

Two embodiments of the invention will now be described, by way of example, with reference to the accompanying drawings in which:

FIG. 1 is an exploded view of one embodiment showing the attachment of a toy vehicle to a card, FIG. 2 is a transverse cross-sectional view showing the toy vehicle held in position by a retainer, FIG. 3 is a transverse cross-sectional view similar to FIG. 2 showing a method of locating the retainer, FIG. 4 is an exploded view of the other embodiment, FIG. 5 is a transverse cross-sectional view showing the vehicle of FIG. 4 held in position by a retainer, and FIGS. 6A–6C show the method of locating and removing the retainer of FIG. 5.

Referring to FIGS. 1 to 3, each retainer 1 comprises a unitary moulding of plastics material having a body portion 2 which is generally annular, opposed upstanding portions 3 which can be gripped by forefinger and thumb to resiliently deform the body portion 2 inwardly, and downwardly depending legs 4 having radially outwardly extending projections 5 which are adapted to fit in recesses formed in the vehicle, preferably in the wheels of the vehicle.

To retain the vehicle 6 on the card 7, the card is placed on the vehicle so that the wheels 8 of the vehicle are located adjacent and outwardly of corresponding apertures 9 formed in the card. Each retainer 1 is then moved in the direction of the arrows of FIG. 1 and inserted as illustrated in FIG. 3 with one projection 5 passing through one of the apertures into a recess 10 in the wheel 8 and the body portion 2 of the retainer 1 being compressed by finger and thumb to permit the other projection to be inserted through its corresponding aperture 9 in the sheet 7. Release of the retainer 1 permits it to expand under its inherent resilience so that both projections 5 are located in their respective wheel recesses 10. The operation is repeated for the other retainer 1 and the other pair of vehicle wheels 8.

Thus, it will be seen that a vehicle is securely held in place and the assembly of vehicle 6, sheet 7 and retainers 1 can be packaged in any suitable manner. To release the vehicle the above-described procedure is reversed, the finger grips 3 being urged together to release the projections 5 from the respective wheel recesses 10.

In the second embodiment illustrated in FIGS. 4 to 6 parts corresponding to those of the above-described embodiment have been allotted the same reference numerals.

In this case each retainer 1' comprises an elongate base portion 11 having projections 12,13 which extend laterally from a generally circular central part 14 of the body portion. One of the projections 13 is substantially rectangular and the other 12 is formed on the end of a cam surface 15 which as shown is straight, but could of course adopt other shapes. Both projections could be provided by cam surfaces if so desired.

The assembly is constructed by placing the sheet 7 over the vehicle 6, or by moving the vehicle in the direction of the arrows of FIG. 4 against the sheet, so that the wheels 8 of the vehicle extend through the apertures 9 in the sheet.

The method of attachment of the retainer 1 to the wheels 8 of the vehicle is illustrated in FIGS. 6A to 6C. The rectangular projection 13 is first inserted in one of the wheel recesses 10 and an upstanding portion 16 of the retainer is gripped and the retainer 1 rotated in a clockwise direction, as illustrated by the arrow, so that the cam surface 15 engages an edge of the wheel 8 and deforms the wheel and axle assembly (FIG. 6A). The wheel is urged outwardly until the projection 12 is located within the wheel recess 10 at which time the wheel returns to its relaxed position and the retainer is located as illustrated in FIG. 6B and in FIG. 5 with the vehicle held on the sheet.

To remove the vehicle, the retainer is again rotated in a clockwise direction, as shown by the arrow in FIG. 6C, and the cam surface 15 acts on the inner edge of the wheel 8 until the cam projection 12 is released from the wheel recess, after which the opposite projection 13 can be released from its wheel recess.

Although described above in relation to retention of toy vehicles, it will be appreciated that the invention is applicable to the retention of other articles which have recesses into which the projections of the retainer can extend to retain the article on the sheet.

In each of the above described embodiments, the vehicle is securely retained on the sheet and will not move when packaged in, for example, a plastics shroud. The shroud would not, therefore, be damaged in transit by movement of the vehicle.

While both described embodiments rely on deformation either of the retaininer means or of the wheel to which the retainer is attached, it will be appreciated that the first embodiment has the particular advantage that it shows the whole of the vehicle, including the wheels, on one side of the card, which is advantageous for purposes of display in shops.

Although described above as separate, adjacent, laterally spaced apart apertures 9 may be interconnected by a third aperture, for example as shown at 9A in FIG. 1, provided that sufficient area of the sheet is still engageable by the retainer to hold the vehicle in place.

I claim:

1. An assembly of a toy vehicle on a sheet, wherein said vehicle has wheels defining at least two recesses, said sheet having apertures therein through which said recesses extend, and said vehicle lying substantially on one side of said sheet, the assembly further including retaining means which retains said vehicle against said sheet and which comprises a body portion located on an opposite side of said sheet relative to said vehicle and at least two projections which extend from said body portion and respectively engage in said recesses in said wheels.

2. An assembly according to claim 1, wherein said retaining means has only two of said projections, one of said projections having a cam surface which is adapted to engage and deform said wheels adjacent one of said recesses during insertion of said projection into said one recess.

3. An assembly according to claim 2, wherein the other of said projections has a substantially rectangular configuration.

4. An assembly according to claim 2, wherein said projections are located opposite one another.

5. An assembly according to claim 2, wherein said body portion and said projections extending therefrom are in the same plane.

6. An assembly according to claim 2, wherein said body portion has a grippable portion extending outwardly therefrom.

7. An assembly according to claim 2, wherein said retaining means is substantially rigid.

* * * * *